US006528980B1

(12) United States Patent
Smith

(10) Patent No.: US 6,528,980 B1
(45) Date of Patent: Mar. 4, 2003

(54) METHOD AND SYSTEM FOR MULTIPLE BIAS CURRENT GENERATOR CIRCUITS THAT START EACH OTHER

(75) Inventor: Gregory J. Smith, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/815,495

(22) Filed: Mar. 22, 2001

(51) Int. Cl.[7] ..... G05F 3/16
(52) U.S. Cl. ..... 323/315
(58) Field of Search ..... 323/312, 313, 323/314, 315, 901; 327/534, 535, 538, 539

(56) References Cited

U.S. PATENT DOCUMENTS 5,404,096 A * 4/1995 Thiel ..... 323/312
5,754,039 A * 5/1998 Nishimura ..... 323/315
6,191,644 B1 * 2/2001 Srinath et al. ..... 327/539
6,285,223 B1 * 9/2001 Smith ..... 327/143

* cited by examiner

*Primary Examiner*—Matthew V Nguyen
(74) *Attorney, Agent, or Firm*—Wagner, Murabito & Hao LLP

(57) ABSTRACT

A startup circuit for producing a startup current for an integrated circuit device. The startup circuit utilizes a wide channel transistor for producing a subthreshold leakage current. A current mirror is coupled to the wide channel resistor and is configured to receive the subthreshold leakage current and produce a startup current therefrom. The subthreshold leakage current produced by the wide channel transistor is constant with respect to a power supply voltage. The current mirror includes a first transistor diode connected to the wide channel transistor and a second transistor having a gate connected to a gate of the first transistor. Within an integrated circuit device, a plurality of startup circuits are provided, each configured to produce a startup current. A plurality of bias current generators are respectively coupled to the startup circuits to receive the startup currents and generate a bias current therefrom. A distribution circuit is coupled to the startup circuits to distribute the startup current produced by the startup circuits among the startup circuits. The distribution circuit is configured to distribute the startup current among the startup circuits such that a startup current from one of the plurality of startup circuits insures that other ones of the plurality of startup circuits will produce their respective startup currents.

18 Claims, 8 Drawing Sheets

METHOD AND SYSTEM FOR MULTIPLE BIAS CURRENT GENERATOR CIRCUITS THAT START EACH OTHER

TECHNICAL FIELD

The present invention relates to the field of low-power integrated circuits. More particularly, the present invention relates to a low-power startup circuit for use with bias current generators for integrated circuits.

BACKGROUND ART

Within the communications industry, there is an ever increasing need for higher performance portable devices having long battery lives. For example, handheld personal information devices (e.g., palmtop computers), cell phones, pagers, and the like, are processing data at faster rates, performing more sophisticated functions, and storing larger amounts of data, while simultaneously functioning for increased periods of time on internal battery power. For example, it is not uncommon for modern cell phone devices to operate continuously in standby mode for several days on end.

Low-power integrated circuits are critical to extend functioning on internal battery power for such handheld devices. To extend battery life, many handheld devices are designed to enter a standby mode when there full functionality is not required by the user. For example, a cell phone is designed to enter a standby mode when it is not being used in a voice conversation. The cell phone can "wake up" from standby when a call is received or when the user desires to place a new call. Similarly, many personal information devices are designed to enter standby mode after some duration of non-use from the user, and wake up when the user activates some function, accesses some data (e.g., clicks a GUI icon) etc. While in standby mode, modern battery power devices are designed to require minimal amounts of power, thereby extending their battery lives.

Well-designed standby mechanisms can greatly extend the functional life of a portable battery power device. Accordingly, the design of integrated circuits that implement standby modes, wake up modes, and full functionality is an area of great interest to the electronics industry. The design of an optimal standby mechanism can be challenging. For example, not only does the standby circuitry have to draw minimal amounts of current while in standby, the standby circuitry has to reliably wake up the device upon some external event, such as, in the case of a cell phone, receiving an incoming phone call. Specific circuits have been designed to ensure the overall device reliably wakes up after being in standby. Such circuits are referred to as startup circuits. Startup circuits are used in powering up devices from a power off condition in addition to waking up devices from sleep modes. For example, the startup circuit must ensure a device reliably powers on from an off state in a predictable fashion, into a known operating state.

Prior art FIG. 1A, FIG. 1B, and FIG. 1C show schematic diagrams of prior art of startup circuits. FIG. 1A shows a startup circuit 10. Startup circuit 10 relies on a very large resistor 11 (e.g., 50 mega-ohms) to reduce the magnitude of the startup current Istart1. The startup current Istart1 is used to start the bias generator circuit 12. Istart1 flows continuously and needs to be a constant magnitude. This startup current is what enables the bias generator 12 to wake up the overall device. For example, the startup current allows bias generator 12 to generate a biasing current for the rest of the device (not shown) that in turn, allows the startup of circuit elements such as VCOs, PLLs, output drivers, and the like. If Istart1 is too low, the bias generator 12 cannot wake up the rest of the circuit. If Istart1 is too high, the standby power consumption will be too high, and thus, battery life will be too short. Startup circuit 10 uses the very large resistor 11 to tailor the magnitude of the startup current Istart1.

There exists a problem with startup circuit 10 however, in that it is very difficult to fabricate very large resistors such as the 50 mega-ohm resistor 11 using VLSI fabrication techniques. With sub-micron fabrication techniques, large resistors require an excessive amount of die surface area. In addition, it is difficult to reliably ensure the correct magnitude of the resistor.

Prior art FIG. 1B shows startup circuit 20 and prior art FIG. 1C shows startup circuit 30. Startup circuits 20 and 30 attempt to reduce the problem of the large resistor 11 from startup circuit 10 by chaining together transistors to reduce the need for such a large resistor. In startup circuit 20, a set of diode connected transistors 21–23 are included to reduce the voltage drop experienced by the resistor 25. In this manner, the transistors 21–23 multiply the resistance of resistor 25. In startup circuit 30, a string of very long channel transistors are used to completely replace the large resistor 11 of startup circuit 10. Startup circuits 20 and 30 are both functional, however, they both produce undesirable characteristics in their startup currents Istart2 and Istart3.

Prior art FIG. 2 shows a graph depicting the magnitude of the startup currents Istart1, Istart2, and Istart3 with respect to the voltage level of the battery (e.g., Vdd). As shown in FIG. 2, line 40 shows an ideal case for a startup current. In the ideal case (line 40), the startup current is constant with respect to the voltage level of the battery. Thus, as the battery slowly drains over time, the start up current remains at the optimal level (e.g., 100 nA). None of the startup currents is close to ideal, however, Istart1 from startup circuit 10 is more desirable since it increases linearly with battery power, while Istart2 and Istart3 are sharply non-linear. Thus, there exists the problem where startup circuits 20 and 30 suffer from poor low battery operation, while startup circuit 10 relies upon the difficult to fabricate large resistor 11.

Thus, what is required is a startup circuit which maintains a more constant, non-varying startup current over a range of power supply voltage level, in comparison to the prior art. What is required is a startup circuit than maintains a constant startup current that can be readily fabricated using modern VLSI fabrication techniques. In addition, what is required is a startup circuit that will reliably produce the required amount of startup current in order to reliably wake up an integrated circuit. The present invention provides a novel solution to the above requirements.

SUMMARY OF THE INVENTION

The present invention is a startup circuit which maintains a more constant, non-varying startup current over a range of power supply voltage level, in comparison to the prior art. The startup circuit of the present invention maintains a constant startup current that can be readily fabricated using modern VLSI fabrication techniques. In addition, the startup circuit of present invention will reliably produce the required amount of startup current in order to reliably wake up an integrated circuit.

In one embodiment, the present invention is implemented as a startup circuit having a wide channel transistor for producing a subthreshold leakage current. A current mirror is coupled to the wide channel resistor and is configured to receive the subthreshold leakage current and produce a startup current therefrom. The subthreshold leakage current produced by the wide channel transistor is constant with respect to a power supply voltage. The subthreshold leakage current produced by the wide channel transistor is constant with respect to a power supply voltage. The current mirror includes a first transistor diode connected to the wide channel transistor and a second transistor having a gate connected to a gate of the first transistor. The gate of the wide channel transistor is coupled to the gates of the first transistor and second transistor of the current mirror.

In so doing, the startup circuit of the present invention maintains a more constant, non-varying startup current over a range of power supply voltage level, and will reliably produce the required amount of startup current in order to reliably wake up an integrated circuit. The startup circuit of the present invention can be readily fabricated using modern VLSI fabrication techniques since no large resistors are required.

Within an integrated circuit device, in a multiple bias current generator block implementation, a plurality of startup circuits are provided, each configured to produce a startup current. A plurality of bias current generators are respectively coupled to the startup circuits to receive the startup currents and generate a bias current therefrom. A distribution circuit is coupled to the startup circuits to distribute the startup current produced by the startup circuits among the startup circuits. The distribution circuit is configured to distribute the startup current among the startup circuits such that a startup current from one of the plurality of startup circuits insures that other ones of the plurality of startup circuits will produce their respective startup currents. The plurality of bias current generators and the plurality of startup circuits are respectively combined into bias current generator blocks within the integrated circuit device. The bias current generator blocks are distributed within the integrated circuit device to provide respective startup bias currents to respective portions of the integrated circuit device.

BRIEF DESCRIPTION OF THE DRAWINGS

The present invention is illustrated by way of example and not by way of limitation, in the Figures of the accompanying drawings and in which like reference numerals refer to similar elements and in which.

Prior art

Prior art

Prior art

Prior art

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The present invention comprises a startup circuit which maintains a more constant, non-varying startup current over a range of power supply voltage level, in comparison to the prior art. The startup circuit of the present invention maintains a constant startup current that can be readily fabricated using modern VLSI fabrication techniques. In addition, the startup circuit of present invention will reliably produce the required amount of startup current in order to reliably wake up an integrated circuit. The present invention and its benefits are further described below.

Figure 3:
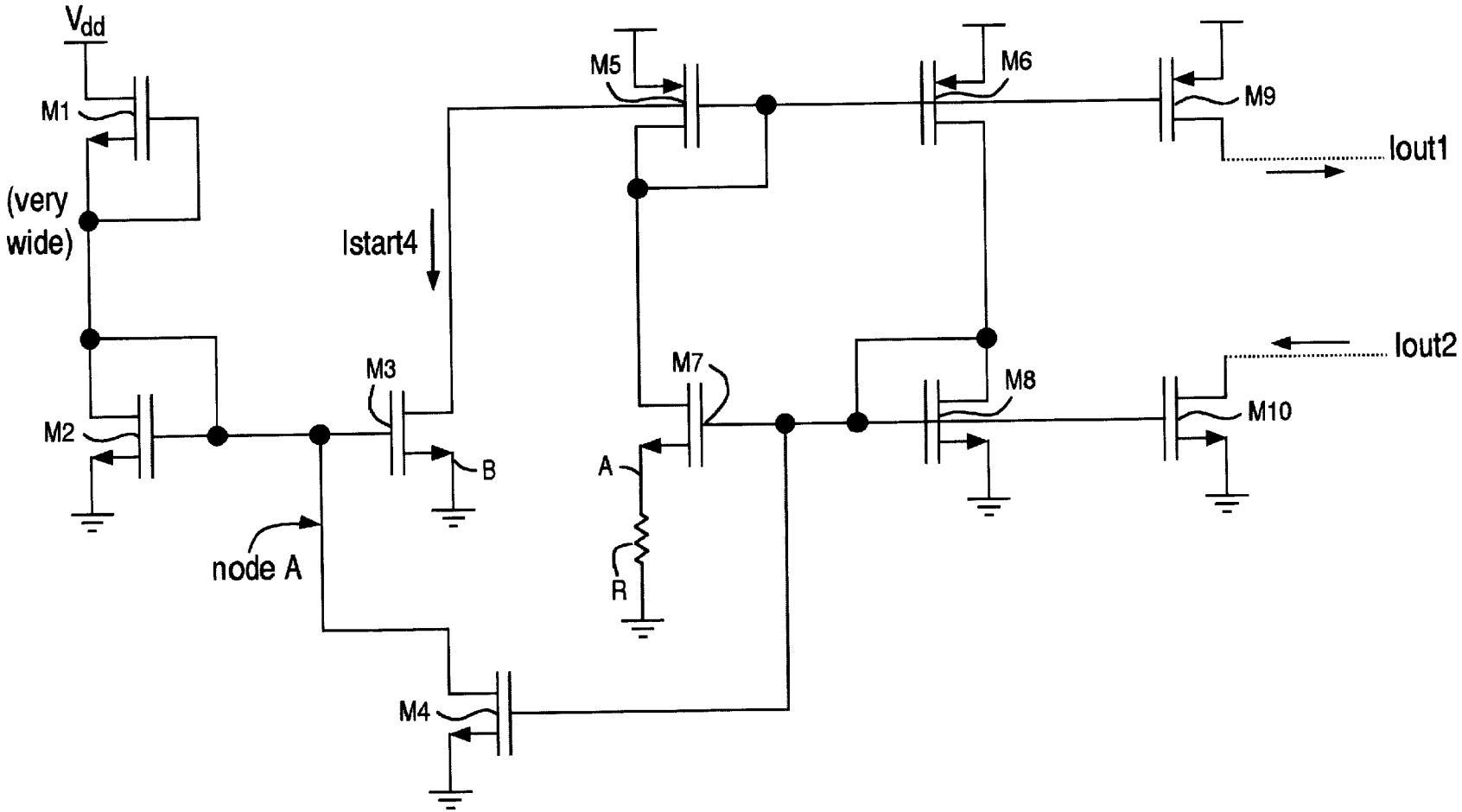
FIG. 3 shows a diagram of a startup circuit in accordance with one embodiment of the present invention.

FIG. 3 shows a startup circuit and a bias current generator circuit in accordance with one embodiment of present invention. As depicted in FIG. 3, the startup circuit includes transistors M1, M2, and M3. The bias generator circuit includes transistors M4, M5, M6, M7, M8, M9, and M10.

Within the bias generator circuit, transistors M5–M8 form a bias current loop. There are 2 stable states for the bias current loop, one being a state where there is zero current, and the other where all 4 transistors M5–M8 operate at $(Vgs_{M8}-Vgs_{M7})/R$, where M7's W/L is A times larger than M8. In standby, there is zero current flowing through the bias current loop. To wake up, or in other words, to move the bias current loop off of the stable zero current state, a startup current must be applied. In addition, so as not to unbalance the generated bias current, the startup current must be removed after startup of the bias current loop.

Referring still to FIG. 3, in accordance with the present invention, a subthreshold leakage current through transistors M1 is utilized to create the startup current. This current is mirrored into the M5–M8 bias current loop, depicted as Istart4, via a current mirror formed by transistors M2 and M3. Once started, M4 is used to turnoff M3's current. M1's current is established by its subthreshold leakage current. Even for moderately wide (i.e., 500×W/L) devices, the startup current is measured on the order of nA. This is good for very low power circuits because the startup current is wasted supply current after startup, yet it is low enough to warrant concerns of signal loss to other leakages. In addition, M1's sub-threshold leakage current is relatively constant as the magnitude of Vdd changes (e.g., battery power dissipates).

Figure 1A:
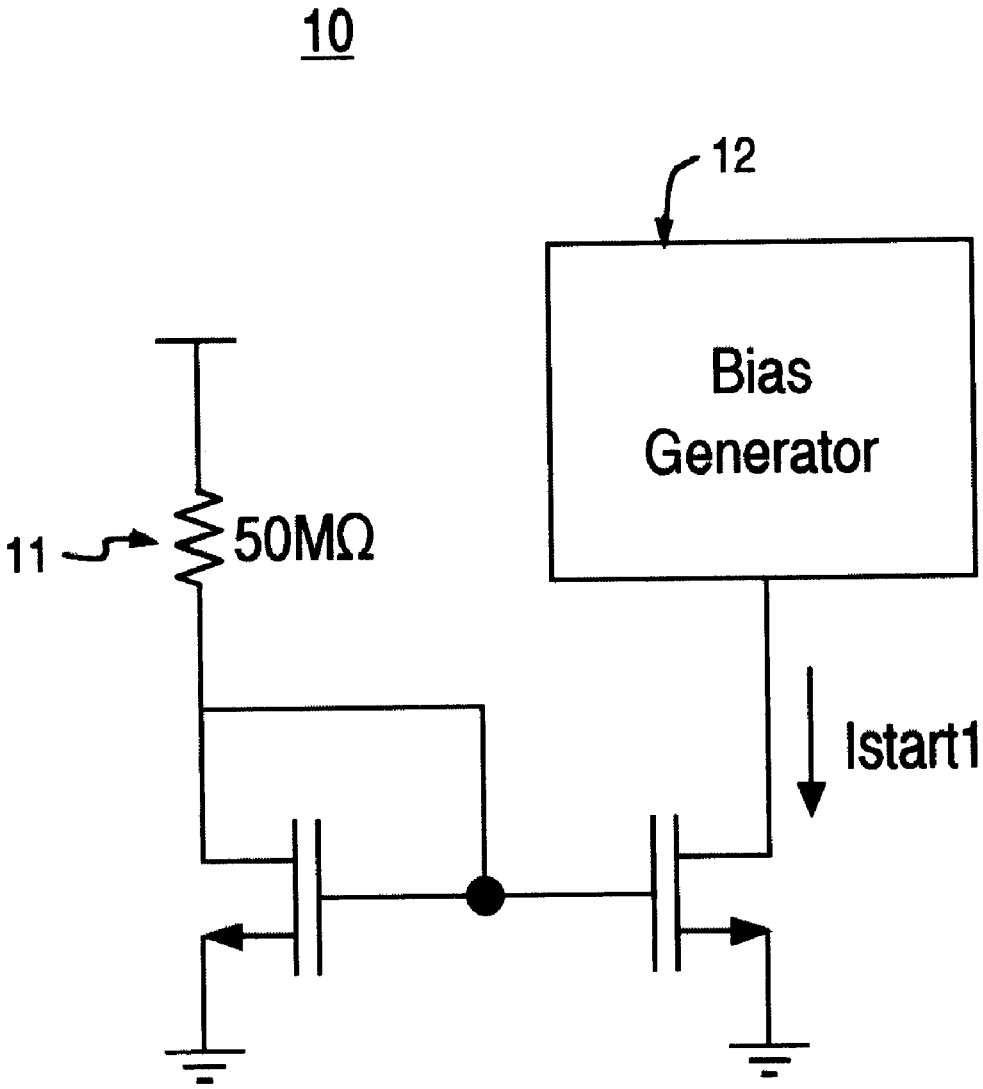
Figure 1A (Prior Art)
FIG. 1A shows a diagram of a first startup circuit in accordance with the prior art.
Figure 1B:
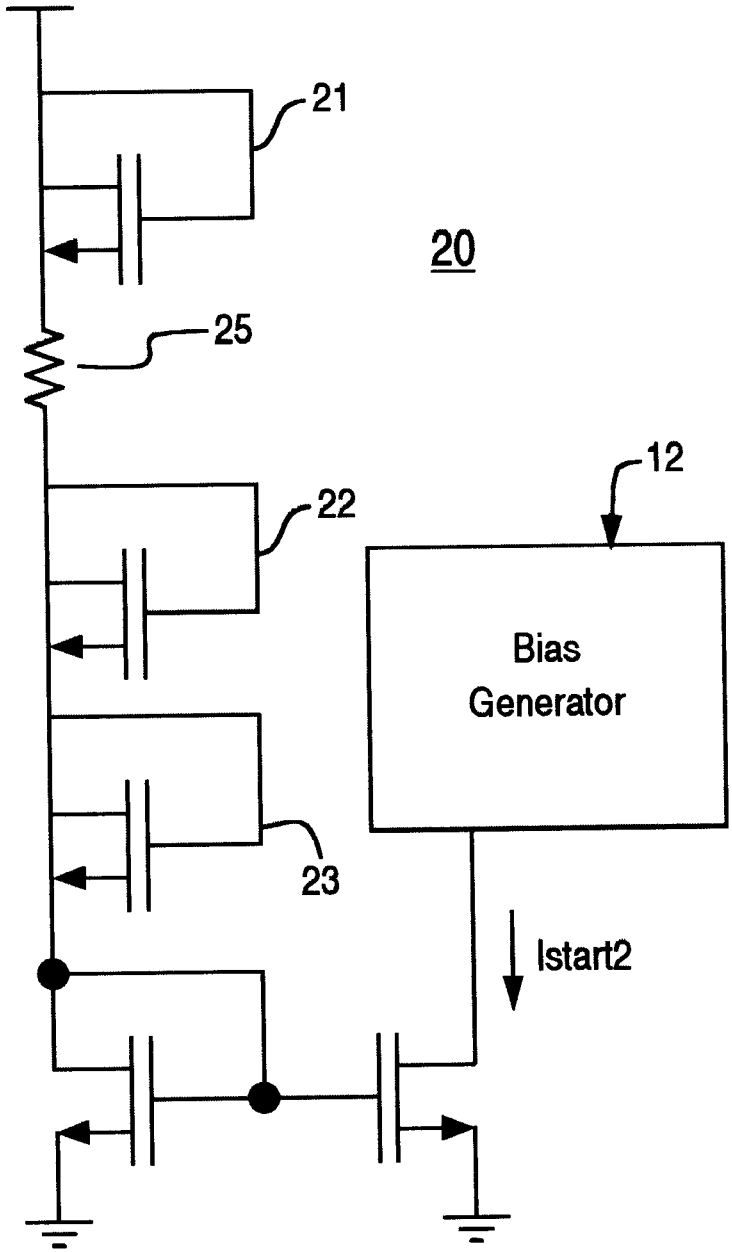
Figure 1B (Prior Art)
FIG. 1B shows a diagram of a second startup circuit in accordance with the prior art.

The use of a subthreshold leakage current in accordance with the present invention provides a number of advantages for a standard CMOS process. For example, ideally, micropower circuits require startup currents under b 100nA and require the startup currents to remain constant with respect to power supply voltage changes. Resistors that would replace M1 would have to be in the 100–500 megaohm range. Such large resistors are very difficult to produce (e.g., prior art FIG. 1A). Alternatively, a series of diode connected transistors could be used to reduce the resistor's voltage drop. Unfortunately, the series would cause a very rapid increase in Istart as the power supply voltage is increased over a threshold that establishes 100 nA (e.g., prior art FIG. 1B). Similarly, series strings of very long channel diode connected transistors could be used, but these have a geometric increase in Istart with power supply voltage. In comparison, the Istart4 startup current produced in accordance with the present invention is very stable over ranges of power supply voltage.

Figure 1C:
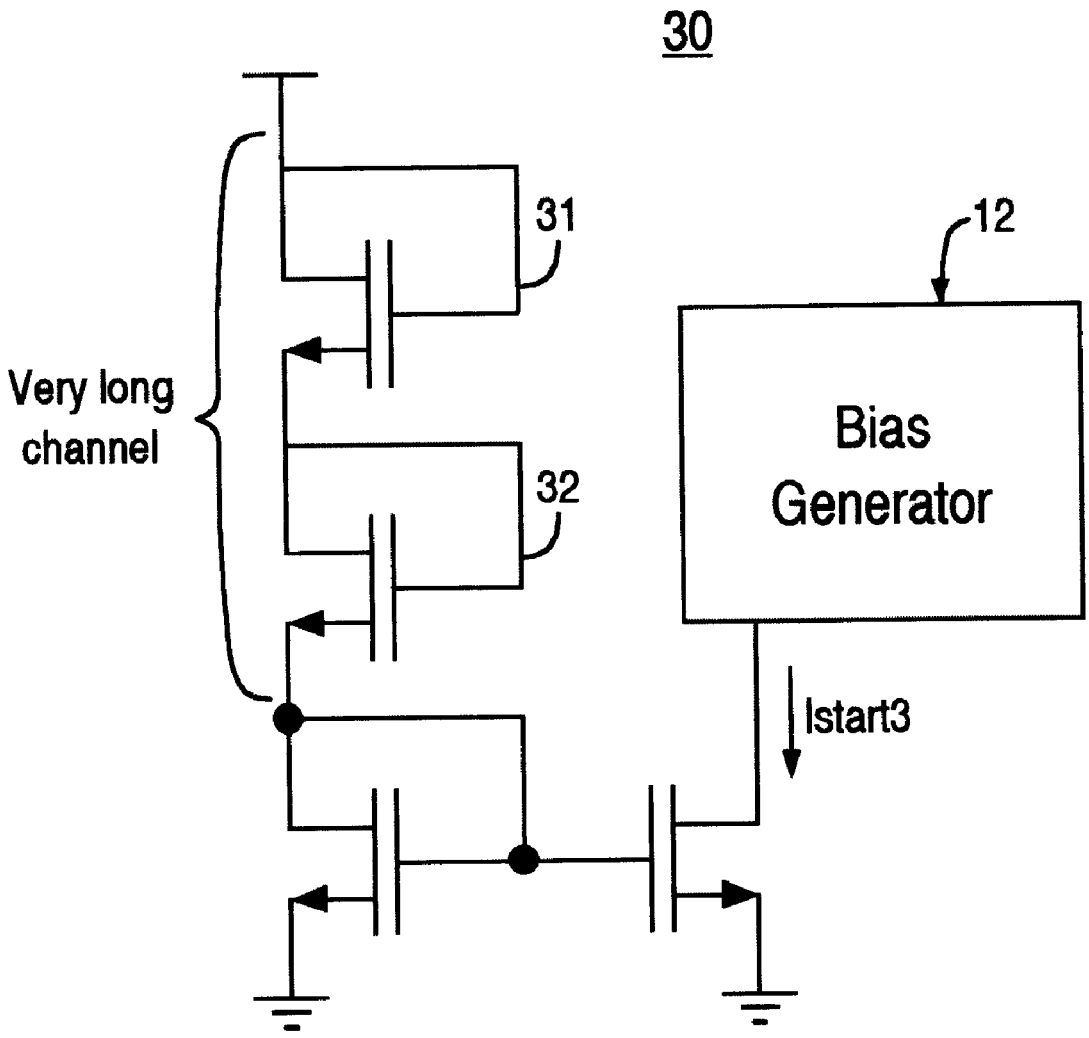
Figure 1C (Prior Art)
FIG. 1C shows a diagram of a third startup circuit in accordance with the prior art.
Figure 2:
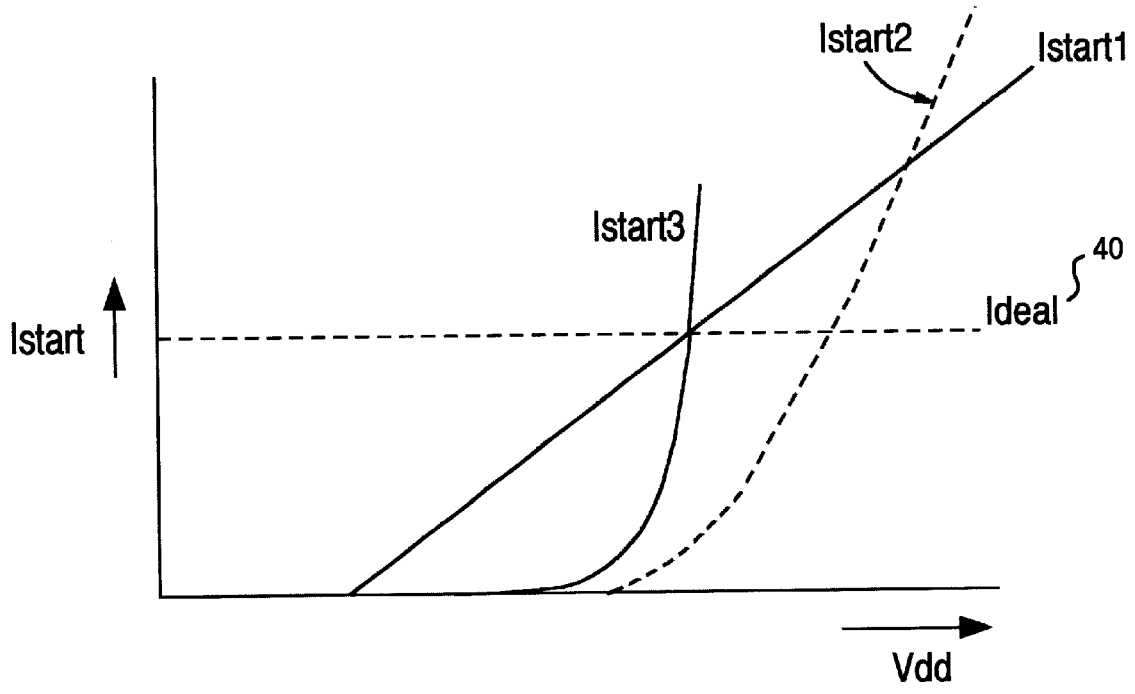
Figure 2 (Prior Art)
FIG. 2 shows a graph of the startup currents from the startup circuits of FIGS. 1A–C vs. an ideal startup current.
Figure 4:
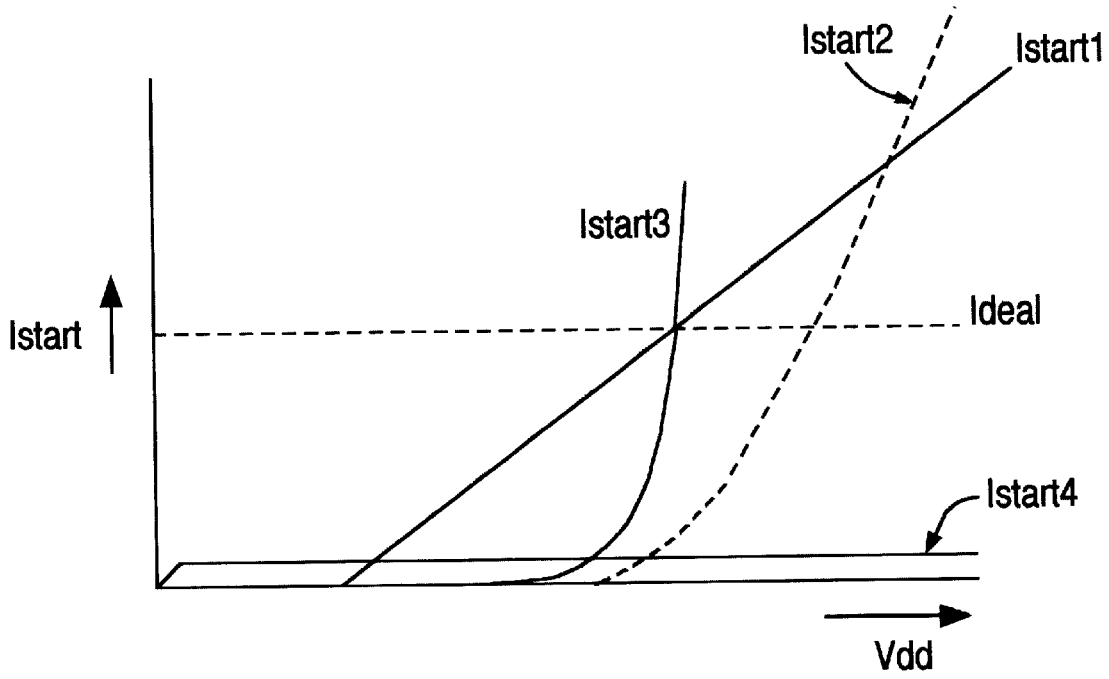
FIG. 4 shows a graph of the startup current from the startup circuit of FIG. 3 with respect to the startup currents from the startup circuits of FIGS. 1A–C and an ideal startup current.

FIG. 4 shows a graph depicting the start up current Istart4 from the start up circuit of FIG. 3 over different values of power supply voltage Vdd. For comparison, FIG. 4 also shows the start up currents Istart1, Istart2, and Istart3 from Prior art FIGS. 1A–1C. As described above, ideally, the start up current would be constant with respect to Vdd, remaining at a constant magnitude as Vdd changes (e.g., battery drains over time). This is shown in FIG. 4 by the ideal line. As described above, Istart1, Istart2, and Istart3 are significantly problematic, in that their magnitude changes rapidly with Vdd. In contrast, Istart4 is relatively more constant with changes in Vdd. As shown in FIG. 4, Istart4 ramps up very quickly from zero to its steady state as Vdd increases from zero.

Thus a primary advantage of using the subthreshold leakage current as in FIG. 4 is the constant low voltage and high voltage operation. However, as shown in FIG. 4, the magnitude of Istart1 is much less than ideal. Thus, it should be appreciated that one potential disadvantage of using the subthreshold leakage current as the startup current generator is that it may be very low in value. In general, the feedback of the M5–M8 bias current loop is such that any positive non-zero start current will start the loop toward its other desired stable state. M3's W/L can be greater than M2 to increase the effective starting current without increasing the wasted steady state current in the startup turnoff device M4. Yet there still exist a concern that random silicon defects in M2 and M4 could cause leakage currents to ground that overwhelm M1's source current, pull down node A, and reduce Istart4 to zero. M1 is already defined, as about 2 orders of magnitude wider than M1 and M4, so it is impractical to increase M1 much beyond this. The present invention solves this potential problem by "chaining" together multiple startup circuits such that they effectively start each other.

Figure 5:
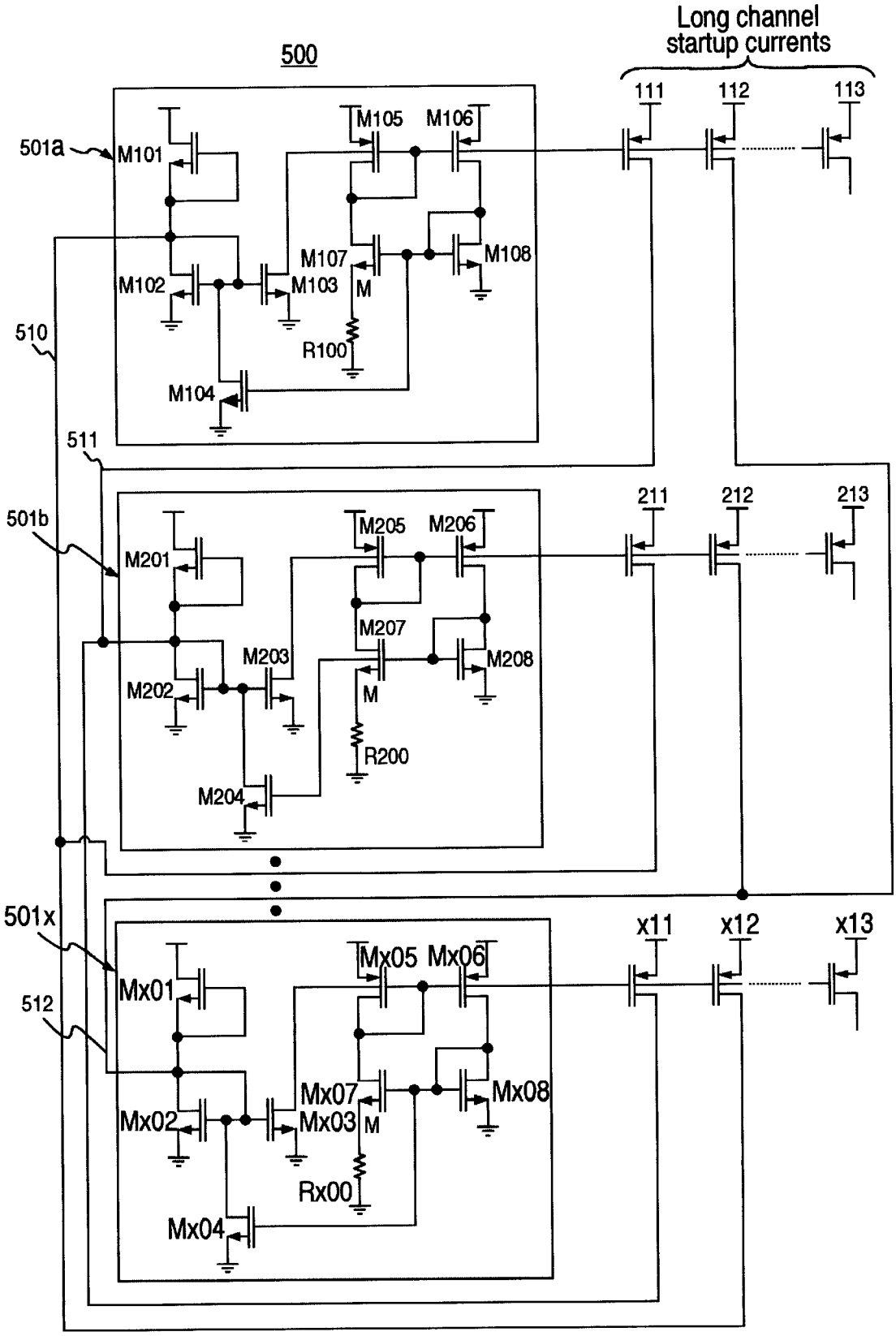
FIG. 5 shows a diagram of a multiple bias current generator block system in accordance with one embodiment of the present invention.

FIG. 5 shows a startup circuit system 500 in accordance with one embodiment of the present invention. As depicted in FIG. 5, startup circuit system 500 includes a plurality of the bias current generators, 501*a*, 501*b*, through 501*x*. Each of the bias current generators 501*a–x* is coupled to its respective corresponding startup circuit. For example, transistors M101, M102, and M103 comprise the startup circuit for bias current generator 501*a*, transistors M201, M202, and M203 comprise the startup circuit for bias current generator 501*b*, and so on. The plurality of bias current generators and the plurality of startup circuits are respectively combined into bias current generator blocks within the integrated circuit device. Within an integrated circuit device, a plurality of bias current generator blocks (e.g., bias current generators 501*a–x*) are distributed to provide startup bias currents to appropriate components of integrated circuit device (e.g., VCOs, PLLs, crystal oscillators, etc.).

A distribution circuit comprising lines 510, 511, and 512 is coupled to the startup circuits of bias current generators 501*a–x* to distribute the startup current produced by the startup circuits among the startup circuits. The distribution circuit is configured to distribute the startup current among the startup circuits of the bias current generator blocks such that a startup current from one of the plurality of startup circuits insures that other ones of the plurality of startup circuits will produce their respective startup currents. The bias current generator blocks are distributed within the integrated circuit device to provide respective startup bias currents to respective portions of the integrated circuit device. So long as one block successfully starts up, all blocks coupled to the distribution circuit will start up.

In this manner, the distribution circuit (e.g., lines 510–512) provides a mechanism that overcomes this potential weakness of random defect leakages exceeding the subthreshold leakage current of the startup circuit. The use of multiple bias current generator blocks takes advantage of the fact that for many complex mixed signal circuit applications, there exists a multiplicity of bias generators for various analog blocks within the integrated circuit device. In accordance with the present embodiment, any one of the bias current generator blocks provides a startup current for all of the other blocks. This means that only one of the blocks needs to successfully self-start and all of the others will be started.

It should be noted that FIG. 5 also depicts current mirrors respectively coupled to the bias current generators 501*a–x*. Transistors 111–113 comprise the current mirrors for bias current generator 501*a*, transistors 211–213 comprise the current mirrors for bias current generator 501*b*, and likewise, transistors x11–x13 comprise the current mirrors for bias current generator 501*x*. In addition, the use of long channel startup currents provided by the current mirrors (e.g., current mirrors 111–113) usually precludes the sharing of one bias current generator block among the multiple analog blocks of an integrated circuit device. The routing of the currents produced by the bias current generator blocks through the current mirrors functions in part to isolate communication (e.g., interference, crosstalk, etc.) between adjacent analog blocks. Sharing the output of a single bias current generator block among multiple analog circuit blocks tends to add accumulative errors. Also some redundancy is usually required for fail-safe operation of the integrated circuit device.

Figure 6:
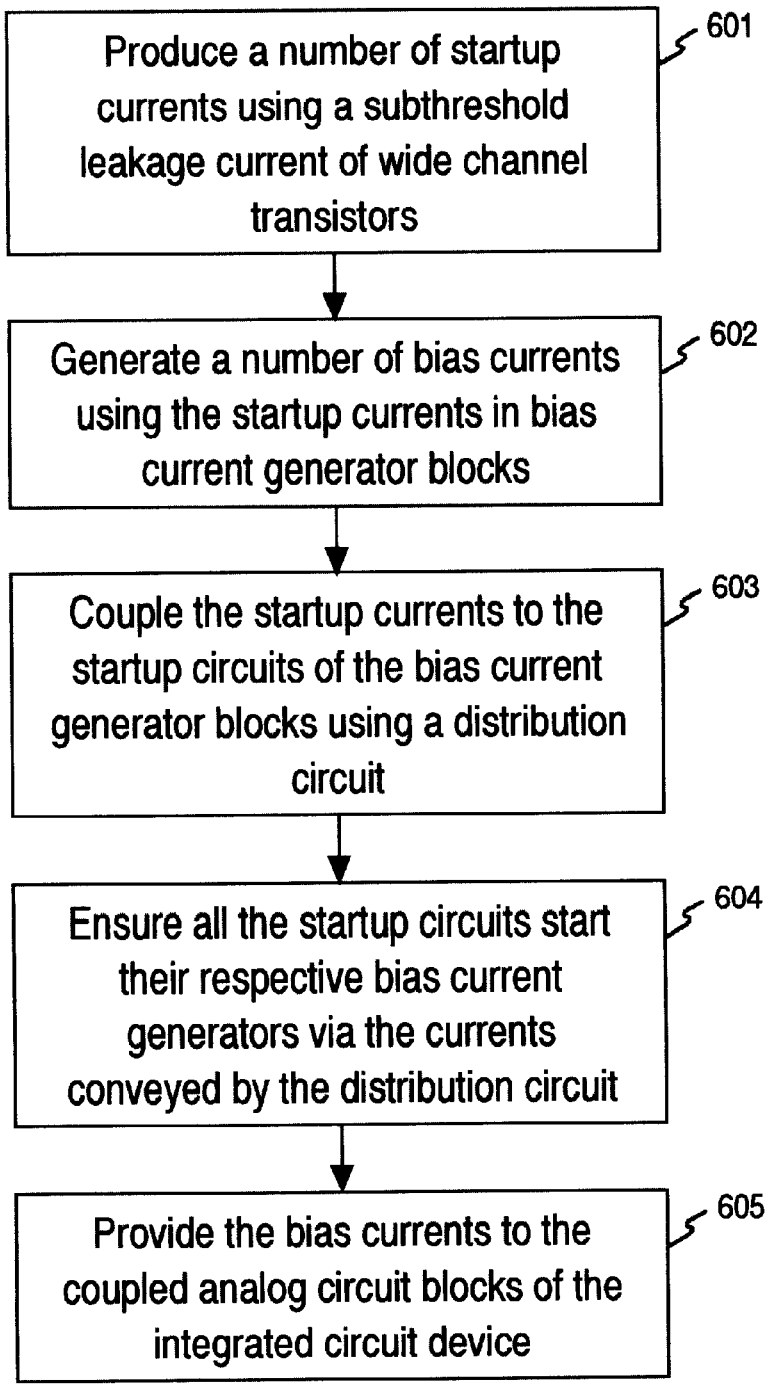
FIG. 6 shows a flowchart of the steps of a bias current generator startup process in accordance with one embodiment of the present invention.

Referring now to FIG. 6, a flowchart of the steps of a bias current generation process 600 in accordance with one embodiment of the present invention is shown. Process 600 depicts the operating steps of a startup circuit system having multiple bias current generator blocks (e.g., system 500 of FIG. 5).

Process 600 begins in step 601, where a number of startup currents are generated using a subthreshold leakage current of a wide channel transistor (e.g., transistor M1 of FIG. 3). As described above, the leakage currents of a wide channel transistors are relatively insensitive to changing levels of Vdd. In step 602, a number of bias currents are generated using the startup currents. The bias current generators and startup circuits are combined into bias current generator blocks (e.g., blocks 501*a–x*). In step 603, the startup currents are coupled to the various startup circuits of the bias generator blocks using a distribution circuit.

Referring still to process 600 of FIG. 6, in step 604, the currents conveyed by the distribution circuit are used to ensure all the startup circuits successfully start their coupled bias current generator circuits. As described above, so long as at least one of the bias current generator blocks successfully starts, it will provide a startup current for all of the other blocks. Thus, so long as one of the blocks successfully self-starts, all of the others will be started. Subsequently, in step 605, the bias currents are provided to the coupled analog circuit blocks of the integrated circuit device.

Thus, the present invention comprises a startup circuit which maintains a more constant, non-varying startup current over a range of power supply voltage level, in comparison to the prior art. The startup circuit of the present invention maintains a constant startup current that can be readily fabricated using modern VLSI fabrication techniques. In addition, the startup circuit of present invention will reliably produce the required amount of startup current in order to reliably wake up an integrated circuit.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A startup circuit for producing a startup current for an integrated circuit device, comprising:

a wide channel transistor for producing a subthreshold leakage current; and a current mirror coupled to the wide channel transistor, the current mirror configured to receive the subthreshold leakage current from the wide channel transistor and produce a startup current therefrom for a coupled integrated circuit, the startup current configured for an ensured startup for the integrated circuit device.

2. The startup circuit of claim 1 wherein the subthreshold leakage current produced by the wide channel transistor is constant with respect to a power supply voltage.

3. The startup circuit of claim 1 wherein the current mirror further comprises:

a first transistor diode connected to the wide channel transistor; and a second transistor having a gate connected to a gate of the first transistor.

4. The startup circuit of claim 3 wherein the gate of the wide channel transistor is coupled to the gates of the first transistor and second transistor of the current mirror.

5. The startup circuit of claim 1 wherein the coupled integrated circuit is a bias current generator.

6. A system for producing a startup current for an integrated circuit device, comprising:

a plurality of startup circuits, each of the startup circuits configured to produce a startup current;

a plurality of bias current generators respectively coupled to the startup circuits to receive the startup currents and generate a bias current therefrom; and a distribution circuit coupled to the startup circuits to distribute the startup current produced by the startup circuits among the startup circuits for an ensured startup of the integrated circuit device.

7. The system of claim 6 wherein the distribution circuit is configured to distribute the startup current among the startup circuits such that a startup current from one of the plurality of startup circuits insures that other ones of the plurality of startup circuits will produce their respective startup currents.

8. The system of claim 6 wherein each of the plurality of startup circuits further comprises:

a wide channel transistor for producing a subthreshold leakage current; and a current mirror coupled to the wide channel resistor, the current mirror configured to receive the subthreshold leakage current from the wide channel transistor and produce the startup current therefrom.

9. The system of claim 8 wherein the subthreshold leakage current produced by the wide channel transistor is constant with respect to a power supply voltage.

10. The system of claim 8 wherein the current mirror further comprises:

a first transistor diode connected to the wide channel transistor; and a second transistor having a gate connected to a gate of the first transistor.

11. The system of claim 10 wherein the gate of the wide channel transistor is coupled to the gates of the first transistor and second transistor of the current mirror.

12. The system of claim 6 wherein the plurality of bias current generators and the plurality of startup circuits are respectively combined into bias current generator blocks within the integrated circuit device, and wherein the bias current generator blocks are distributed within the integrated circuit device to provide respective startup bias currents to respective portions of the integrated circuit device.

13. A method for producing a startup current for an integrated circuit device, comprising:

a) producing a plurality of startup currents using a plurality of startup circuits;

b) generating a plurality of bias currents using a plurality of bias current generators respectively coupled to the startup circuits to receive the startup currents therefrom;

c) distributing the startup currents produced by the startup circuits among the startup circuits using a distribution circuit coupled to the startup circuits; and d) using the startup currents to ensure each of the plurality of startup circuits will produce their respective startup currents.

14. The method of claim 13 wherein each of the plurality of startup circuits further comprises:

producing a subthreshold leakage current using a wide channel transistor; and producing the startup current therefrom current mirror coupled to the wide channel resistor, the current mirror configured to receive the subthreshold leakage current from the wide channel transistor.

15. The method of claim 14 wherein the subthreshold leakage current produced by the wide channel transistor is constant with respect to a power supply voltage.

16. The method of claim 14 wherein the current mirror further comprises:

a first transistor diode connected to the wide channel transistor; and a second transistor having a gate connected to a gate of the first transistor.

17. The method of claim 16 wherein the gate of the wide channel transistor is coupled to the gates of the first transistor and second transistor of the current mirror.

18. The method of claim 13 wherein the plurality of bias current generators and the plurality of startup circuits are respectively combined into bias current generator blocks within the integrated circuit device, and wherein the bias current generator blocks are distributed within the integrated circuit device to provide respective startup bias currents to respective portions of the integrated circuit device.

* * * * *